US005299953A

United States Patent [19]

Gerke et al.

[11] Patent Number: 5,299,953

[45] Date of Patent: Apr. 5, 1994

[54] CUTTING AND CLAMPING SLEEVE CONTACT

[75] Inventors: Dieter Gerke; Andrzey Janczak, both of Berlin, Fed. Rep. of Germany

[73] Assignee: Krone Aktiengesellschaft, Berlin, Fed. Rep. of Germany

[21] Appl. No.: 940,201

[22] Filed: Sep. 1, 1992

[30] Foreign Application Priority Data

Sep. 13, 1991 [DE] Fed. Rep. of Germany ..... 4130940

[51] Int. Cl.[5] ..... H01R 4/24

[52] U.S. Cl. ..... 439/395; 29/882; 439/401

[58] Field of Search ..... 439/395–407, 439/409, 410, 417–419; 29/882

[56] References Cited

U.S. PATENT DOCUMENTS

| | | | |
|---|---|---|---|
| 3,845,455 | 10/1974 | Shoemaker | 439/399 |
| 4,236,778 | 12/1980 | Hughes et al. | 439/404 |
| 4,897,040 | 1/1990 | Gerke et al. | 439/399 |
| 4,929,190 | 5/1990 | Gonon et al. | 439/409 |

FOREIGN PATENT DOCUMENTS

3709376C1 5/1988 Fed. Rep. of Germany .

*Primary Examiner*—Eugene F. Desmond

*Attorney, Agent, or Firm*—McGlew and Tuttle

[57] ABSTRACT

The invention relates in general to a cutting and clamping sleeve contact for contacting a cable core transversely to the sleeve axis, and in particular for cable cores of the telecommunication technology. The contact is made of a metal sleeve shell and includes a clamping slot for the insulated cable core and a cutting and clamping contact slot within the sleeve for the stripless termination of the cable core. The present invention also relates to a method for producing the cutting and clamping sleeve contact. A portion 13 of a sleeve shell 12 is bent off radially into an interior of the sleeve body 12 and is provided with a cutting/clamping contact slot 2. A clamping slot 3 is opposite to the cutting/clamping contact slot 2 and is cut into the sleeve shell 15. The present invention improves the cutting and clamping sleeve contact, with regard to the independence of the cutting/clamping slot 2 from the movements at the clamping slot 3, and with regard to the observation of accurate tolerances.

15 Claims, 3 Drawing Sheets

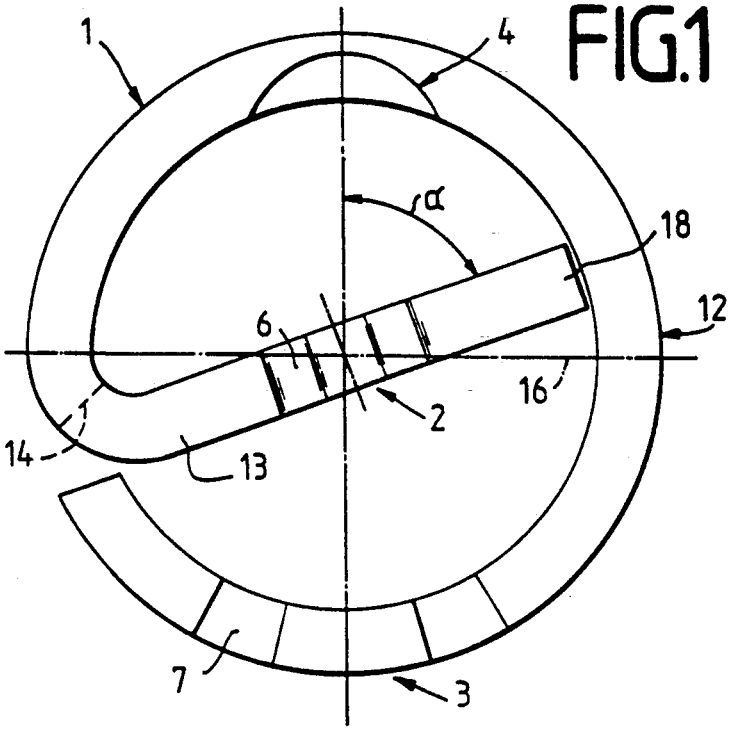
FIG.1
FIG.2
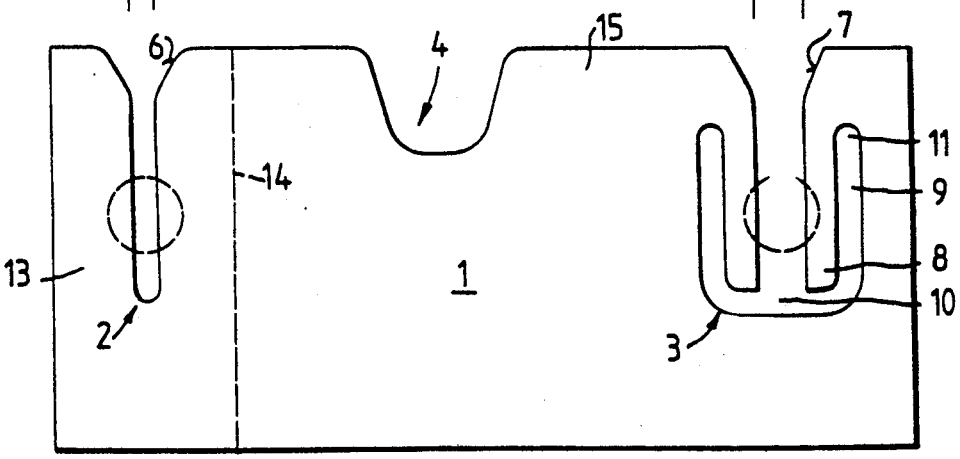

CUTTING AND CLAMPING SLEEVE CONTACT

FIELD OF THE INVENTION

The invention relates in general to a cutting and clamping sleeve contact for contacting a cable core transversely to the sleeve axis, and in particular for cable cores of the telecommunication technology. The sleeve contact is made of a metal sleeve shell and includes a cutting/clamping contact slot within the sleeve for the stripless termination of the cable core. The present invention also relates to a method for producing the cutting and clamping sleeve contact.

BACKGROUND OF THE INVENTION

A similar cutting and clamping sleeve contact of the aforementioned species is known from the German Patent DE 37 09 376 C1. In this document, shell portions are cut free from the metal sleeve shell and are bent off towards the interior of the sleeve as contact legs, so as to form the cutting and clamping contact slot. The clamping slot for holding the insulated cable core is formed by the end edges of the round, oval or polygonal sleeve body being disposed in a small distance. It is disadvantageous, herein, that widening of the clamping slot for the insulated cable core will also cause widening of the cutting and clamping contact slot for the stripless termination of the cable core. This happens in particular, when the contact legs, which are bent off towards the interior of the sleeve and form the cutting and clamping contact slot, are bent from an area adjacent the clamping slot and towards an interior. This further happens when the cable cores having a relatively thick insulating sheath and a small core diameter are terminated at the sleeve contact. The thick insulating sheath widens the clamping slot, resulting in corresponding widening of the cutting and clamping contact slot which may then not be capable to contact the thin wire anymore.

Further, it has been shown that the prior art cutting and clamping sleeve contact exhibited relatively large tolerances of the slot widths from one sleeve contact to other when bending the contact legs together for forming the slot width of the cutting and clamping sleeve contact. Thus, production of the contact slot is practically impossible with acceptable tolerances.

SUMMARY AND OBJECTS OF THE INVENTION

The invention is based on the object, therefore, to improve a cutting and clamping sleeve contact of the aforementioned species such that the cutting/clamping contact slot is not affected by a widening of the clamping slot, and that the production of the contact slot is possible with narrow tolerances.

For the solution of this object, the invention provides that a portion of the sleeve shell is bent off radially into the interior of the sleeve and is provided with the cutting/clamping contact slot, and that the clamping slot opposite to the cutting/clamping contact slot is cut into the sleeve shell. Hereby, the cutting/clamping contact slot as well as the clamping slot are each formed by cutouts in the sleeve shell, thereby narrow tolerances being possible for the formation of clamping slot and cutting/clamping contact slot. Furthermore, the cutting/clamping contact slot is on a portion of the sleeve shell, which is not affected by a possible widening of the clamping slot.

In a preferred embodiment, the cutting/clamping sleeve contact is formed of a metal strip. Prior to bending the metal strip into a sleeve contact, the clamping slot and the contact slot are cut into the metal strip, e.g. by stamping. Simultaneously a cutting position having a sharp edge can be stamped out. Only in a second step, is the final sleeve shape of the cutting and clamping sleeve contact established by bending and rolling up. Thereby, the sleeve shell or metal strip can be adapted in an "e"-shaped design, and an end portion of the sleeve shell or metal strip which receives the cutting and clamping contact slot is bent radially into the interior of the sleeve. In another embodiment, the portion receiving the cutting/clamping contact slot forms a central portion of the sleeve shell, and the end portions of which receive the clamping slot and also the cutting position. These end portions are adjacent to the central portion and are bent off semicircularly and oppositely away from the straight central portion.

After the stamping of the metal strip, the metal strip can be also bent into a substantially "S"-shape with an end portion of the metal strip being curved into a circular portion and a substantially central portion of the metal strip being a diametric portion extending across an interior of the circular portion. The cutting/clamping contact slot means being always formed in the diametrical portion. If an end portion of the metal strip is used to form the diametrical portion, then the sleeve contact takes the "e"-shape. The length of the diametric portion can either be identical to an inner diameter of the circular portion or the length can be larger than the inner diameter. If the length is larger than the circular portion, the circular portion also defines a receiving means for receiving this extra length of the diametrical portion. If the radial length is substantially identical to the inner diameter of the circular portion, support means can be provided on the circular portion to hold and support an end of the diametrical portion. A cutting means can also be provided on the metal strip for cutting the cable. In a preferred embodiment, the cutting means, the clamping slot and the cutting/clamping contact slot means are all positioned substantially in a line, with the cutting/clamping contact slot means being in between the cutting means and the clamping slot. The clamping slot can be partially surrounded by a cut-free section having a substantially "U"-shape. The cut-free section has legs which are positioned adjacent to lugs of the clamping slot. The legs of the cut-free section are also substantially parallel to the lugs of the clamping slot. A base of the cut-free section is substantially perpendicular to the lugs of the clamping slot.

The invention also sets forth a method for producing this sleeve contact. A metal strip is provided, and the clamping slot and the cutting/clamping contact slot means is formed in the metal strip. The metal strip is then bent into a circular portion with a diametrical portion extending radially across the interior of the circular portion. The diametrical portion can be on one end of the metal strip and the other end can then be bent and curved to form the circular portion. In another embodiment, the diametrical portion can be a substantially central portion of the metal strip and ends of the metal strip adjacent to the substantially central portion are then bent with respect to the central portion and these end portions are curved to form the substantially circular portion. The clamping slot, the cutting/clamping contact slot means and a cutting means can all be formed in the metal strip by stamping. The metal strip itself can be formed of a larger metal plate during the same operation as the stamping of the clamping slot, the cutting/clamping contact slot means and the cutting means.

The cutting and clamping sleeve contact can be assembled free-standingly on a printed-circuit board, or can be inserted into a wiring block together with a contact of the same design or with totally different ones as termination or disconnection configurations. The cable cores are clamped, by means of a pressing movement into the clamping slot, are contacted in the cutting/clamping contact slot, and are cut off at the sharp cutting position. Wiring can be achieved by a tool or by closing a cover of a housing, into which the cutting and clamping sleeve contact is inserted. The latter can also be designated as a round tubular contact. The sleeve contact is self-supporting and does not require a housing for supporting or clamping the cable cores, and can, e.g., be mounted directly on a printed-circuit board. The clamping slot of the sleeve contact permits a safe clamping of the cable core, without movements of the cable core being transferred to the cutting/clamping slot. The cable cores or wires need not be cut to a certain length before, but are cut, directly at the sleeve contact, by means of a simple wiring tool without movable parts, when wiring at the sharp cutting edge. The sleeve contact allows a safe contacting of copper wires between 0.32 mm and 0.80 mm diameter, depending on the diameter of the sleeve contact. Further, contacting of stranded wires is also possible. The position of the contact slot opposite to the cable core can be a fork-type or angle-type position between 45° and 90°.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a top view of an "e"-shaped cutting and clamping sleeve contact of the first embodiment;

FIG. 2 is a view of the development of the metal strip forming the sleeve shell of the cutting and clamping sleeve contact with a stamped-in contact slot, stamped-in cutting portion and stamped-in clamping portion;

DETAILED DESCRIPTION OF THE PREFERRED EMBODIMENT

Figure 3:
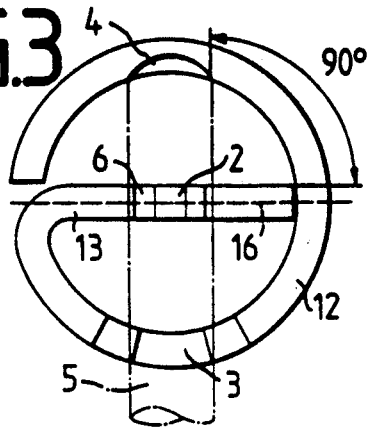
FIGS. 3 to 12 are various embodiments of the "e"-shaped sleeve contact.

In reference to the drawings and in particular to FIG. 1, the cutting and clamping sleeve contact includes in its first embodiment according to FIGS. 1 and 2, a flat metal strip 1 of an electrically conductive material. According to FIG. 2, the flat metal strip 1 has on the left-hand side, a cutting/clamping contact slot means with a cutting/clamping slot 2, and on the right-hand side, a clamping slot 3, and in the center, a cutting position 4. All of these features are provided on the flat metal strip 1 by stamping in a single work step. The cutting/clamping slot 2 has a certain width W, depending on the diameter of the cable cores 5 to be terminated, and the cutting/clamping slot 2 is provided with a V-shaped entry section 6 on an axial side of the metal strip 1. The clamping portion consists of a clamping slot 3 of a width Z. The width Z regularly being larger than the width W of the cutting/clamping slot 2. The clamping slot 3 is also provided with a V-shaped entry section 7 on the axial side of the metal strip 1 and resilience means for forming resilient spring lugs 8 on either side of the clamping slot 3. The resilience means includes a U-shaped cut-free section 9 stamped into the metal strip 1. The base 10 of the cut-free section 9 rectangularly or substantially perpendicularly crosses at an inner end of the clamping slot 3, and legs 11 of the cut-free section 9 extend in parallel to the clamping slot 3 in the direction of the entry section 7 thereof, as is shown in FIG. 2.

As is shown in FIG. 1, the metal strip 1 is, after the stamping process, bent or rolled up, according to FIG. 2, to form a sleeve body 12 having a round or circular cross-section and a diametrical portion 13, being separated from the remaining sleeve shell 15 by a broken line 14. The diametrical portion 13 is a circumferential end portion of the metal strip 1 and extends radially into an interior of the sleeve body 12, as is shown in FIG. 1. The cutting/clamping slot 2 is disposed in the center of the sleeve body 12, and is aligned at an angle $\alpha$ to the transverse axis 16 of the sleeve body. The clamping slot 3 and the opposed cutting position 4 are provided rectangularly or substantially perpendicular to an axis 17, as is shown in FIG. 1. This embodiment of the cutting and clamping sleeve contact forms an "e"-shape with a cutting/clamping contact slot 2 aligned at the angle $\alpha$, obliquely to the axis 17 of the cable core 5 to be terminated. The cable core 5 extending in the direction of the axis 17 (FIG. 1). As is shown in FIG. 1, the portion 13 receiving the cutting/clamping slot 2 is, in this embodiment, not connected with the sleeve shell 12 at the free end 18.

Figure 4:
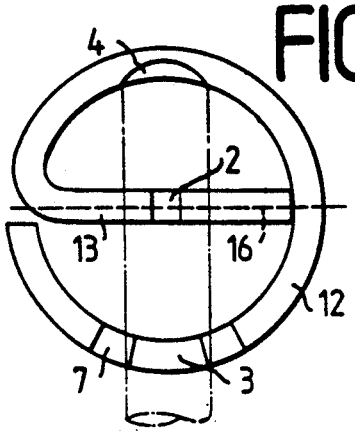

FIGS. 3 to 12 show embodiments modified from the "e"-shape of FIG. 1. FIGS. 3 and 4 show a pure fork-type contact. The diametrical portion 13 of the sleeve shell 12 which is substantially positioned with the transverse axis 16, so that the cutting/clamping slot 2 is substantially parallel to the axis 17 and is vertical thereto, as is shown in FIG. 3. The cutting and clamping sleeve contact according to FIG. 4 corresponds to the shown one in FIG. 3, except that it is oppositely bent off or rolled up, resp.

Figure 5:
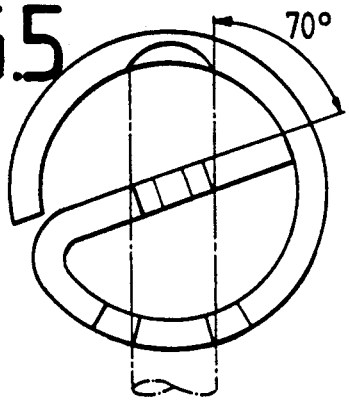
Figure 6:
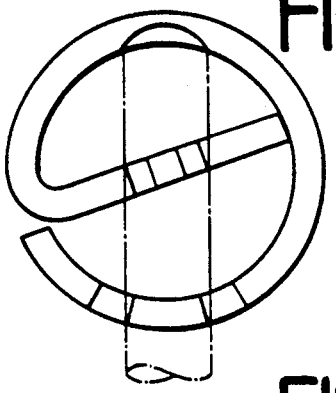

The cutting and clamping sleeve contact shown in FIG. 5 corresponds to that of FIG. 1 and the angle $\alpha$ being specified as substantially 70°. The cutting and clamping sleeve contact according to FIG. 6 corresponds to that of FIG. 5, except that it is oppositely bent off or rolled up, resp.

Figure 7:
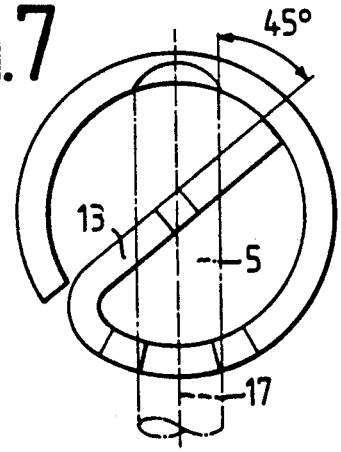
Figure 8:
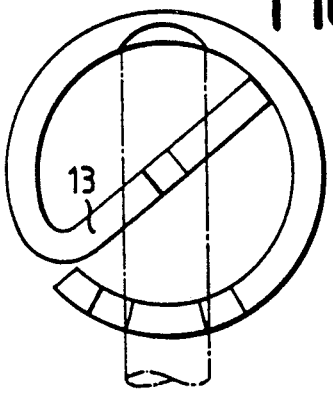
Figure 9:
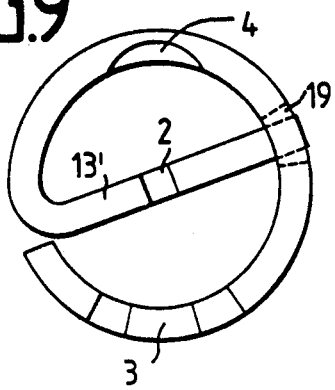

The cutting and clamping contacts shown in FIGS. 7 and 8 have an angle of 45°, at which the portion 13 bent off into the interior of the sleeve body 12 is bent off relative to the axis 17 of the cable core 5.

Figure 10:
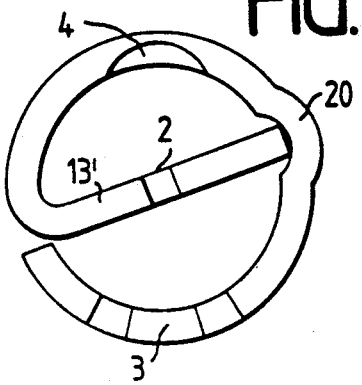
Figure 11:
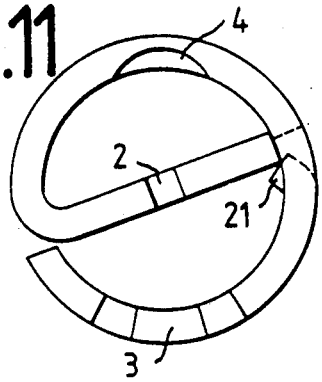
Figure 12:
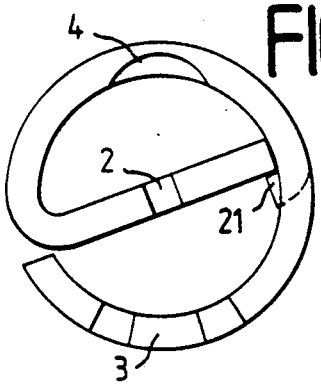

In the cutting and clamping sleeve contacts shown up to now, the radial length of the portion 13 corresponds to the inner diameter of the sleeve body 12. In the embodiments shown in FIGS. 9 and 10, the length of the portion 13' bent off into the interior of the sleeve body 12 is longer than the inner diameter of the sleeve body 12, and receiving portions are provided, for laterally supporting the radial portion 13'. The receiving portions are in a form of an opening 19 (FIG. 9) or in the form of a recess 20 (FIG. 10). The radial portion 13' is laterally supported in these receiving portions. In the embodiments according to FIGS. 11 and 12, the length of the radially inwardly bent off portion 13 again corresponds to the inner diameter of the sleeve body 12, and again receiving portions 18 for the portion 13 are provided. These receiving portions are adapted in the form of inwardly bent off lugs 21, which are cut free from the sleeve shell 15 of the sleeve portion 12 in a U-shaped manner.

Figure 13:
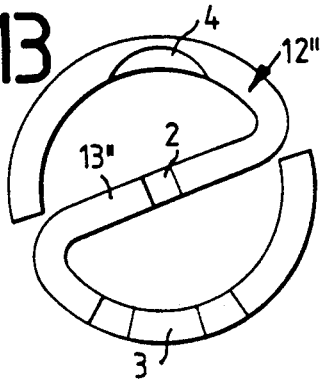
FIG. 13 and 14 are two embodiments of an "S"-shaped sleeve contact.
Figure 14:
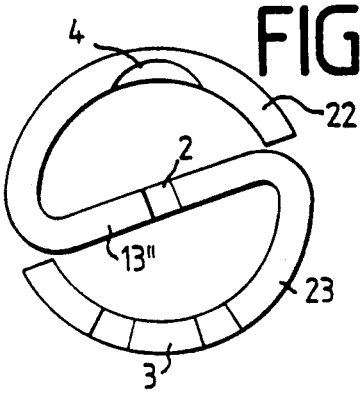

In the embodiments according to FIGS. 13 and 14, the cutting and clamping sleeve contact has, in the top view, an "S"-shape. The portion 13" of the sleeve shell 12" receives the cutting/clamping slot 2 and forms a central portion of the metal strip 1" of the sleeve shell 12" are now circumferential end portions of the metal strip 1. The sleeve portions 22 and 23 of the sleeve body 12' are disposed on either side of the central portion 13" and are formed as one piece with the latter. These sleeve portions are each bent off semicircularly and oppositely to each other, so that such shell portions 22, 23 form the sleeve body 12, which is radially passed by the central portion 13". Herein, the central portion 13" is disposed at a large angle $\alpha$ to the axis 17 of the cable core 5. The cutting position 4 is again diametrically opposite to the clamping slot 3.

What is claimed is:

1. A sleeve contact comprising:

a metal strip including a circular portion and a diametrical portion, said diametrical portion being bent off of said circular portion and extending radially across an interior of said circular portion, said diametrical portion defining a cutting/clamping contact slot means for stripless termination of cable cores, said cutting/clamping contact slot means defining a cutting/clamping slot extending from a first axial side of said metal strip and stopping at a point between said first axial side and a second axial side, said circular portion defining a clamping slot positioned substantially opposite said cutting/-clamping contact slot means, said diametrical portion having a section continuously extending across said cutting/clamping slot.

2. A metal sleeve contact in accordance with claim 1, wherein:

said diametrical portion is a circumferential end portion of said metal strip and said metal strip is bent into a substantially "e"-shaped sleeve body with said circular portion extending from one end of said diametrical portion and in a circle substantially completely around said diametrical portion.

3. A sleeve contact in accordance with claim 1, wherein:

said diametrical portion is a substantially central portion of said metal strip and is bent into a substantially "S"-shaped sleeve body with opposite circumferential end portions extending from opposite sides from said diametrical portion and in substantially similar circumferential directions to form a circle around said diametrical portion.

4. A sleeve contact in accordance with claim 1, wherein:

said cutting/clamping contact slot means and said clamping slot define a cable axis, and said diametrical portion extends across said interior at an angle to said cable axis.

5. A metal sleeve contact in accordance with claim 1, wherein:

said clamping slot also extends from said first axial side and stops at a point between said first axial side and said second axial side of said metal strip.

6. A metal sleeve contact in accordance with claim 1, wherein:

said circular portion has a section continuously extending across said clamping slot.

7. A method for producing a sleeve contact, the method comprising the steps of:

providing a metal strip;

cutting a cutting/clamping slot only partially through said metal strip;

cutting a clamping slot only partially through said metal strip; and bending said metal strip to form a substantially circular portion containing said clamping slot around a diametrical portion containing said cutting/clamping slot and continuously extending radially across said substantially circular portion and to have a circumferential end side of said metal strip positioned adjacent a bend connecting said circular portion to said diametrical portion.

8. A method in accordance with claim 7, wherein:

said forming of said cutting/clamping slot and said clamping slot are performed by stamping.

9. A sleeve contact comprising:

a metal strip including a circular portion and a diametrical portion, said diametrical portion being bent off of said circular portion and extending radially across an interior of said circular portion, said diametrical portion defining a cutting/clamping contact slot means for stripless termination of cable cores, said cutting/clamping contact slot means defining a cutting/clamping slot extending from a first axial side of said metal strip and stopping at a point between said first axial side and a second axial side, said circular portion defining a clamping slot positioned substantially opposite said cutting/-clamping contact slot means, said circular portion including a cutting means for cutting a cable, said cutting means being positioned substantially opposite said clamping slot.

10. A sleeve contact in accordance with claim 9, wherein:

said clamping slot, said cutting means and said cutting/clamping contact slot means are all positioned substantially in a line across the sleeve contact, said cutting/clamping contact slot means being positioned between said clamping slot and said cutting means.

11. A sleeve contact comprising:

a metal strip including a circular portion and a diametrical portion, said diametrical portion being bent off of said circular portion and extending radially across an interior of said circular portion, said diametrical portion defining a cutting/clamping contact slot means for stripless termination of cable cores, said cutting/clamping contact slot means defining a cutting/clamping slot extending from a first axial side of said metal strip and stopping at a point between said first axial side and a second axial side, said circular portion defining a clamping slot positioned substantially opposite said cutting/-clamping contact slot means, said metal strip having lug means for contacting a cable in said clamping slot, and said metal strip having resilience means for forcing said lug means against the cable, said resilience means including a cut-free section defined by said metal strip, said cut-free section being positioned adjacent to and substantially in parallel with said lug means.

12. A sleeve contact in accordance with claim 11, wherein:

said metal strip also includes another lug means for contacting the cable, and said cut-free section has a substantially "U"-shape, said substantially "U"-shape having legs substantially parallel to said lug means and said another lug means, said substantially "U"-shape also having a base substantially perpendicular to said lug means and said another lug means.

13. A sleeve contact comprising:

a metal strip including a circular portion and a diametrical portion, said diametrical portion being bent off of said circular portion and extending radially across an interior of said circular portion, said diametrical portion defining a cutting/clamping contact slot means for stripless termination of cable cores, said cutting/clamping contact slot means defining a cutting/clamping slot extending from a first axial side of said metal strip and stopping at a point between said first axial side and a second axial side, said circular portion defining a clamping slot positioned substantially opposite said cutting/-clamping contact slot means, and said diametrical portion having a length which is larger than an inner diameter of said circular portion, and said circular portion has a receiver portion means for receiving an end of said diametrical portion.

14. A sleeve contact comprising:

a metal strip including a circular portion and a diametrical portion, said diametrical portion being bent off of said circular portion and extending radially across an interior of said circular portion, said diametrical portion defining a cutting/clamping contact slot means for stripless termination of cable cores, said cutting/clamping contact slot means defining a cutting/clamping slot extending from a first axial side of said metal strip and stopping at a point between said first axial side and a second axial side, said circular portion defining a clamping slot positioned substantially opposite said cutting/-clamping contact slot means, said diametrical portion being substantially straight, and end portions of said metal strip extend from said diametrical portion, said end portions being bent off from said diametrical portion and being curved to form said substantially "S"-shaped body.

15. A method for producing a sleeve contact, the method comprising the steps of:

providing a metal strip;

cutting a cutting/clamping slot only partially through said metal strip;

cutting a clamping slot only partially through said metal strip; and bending said metal strip to form a substantially circular portion containing said clamping slot around a diametrical portion containing said cutting/clamping slot and extending radially across said substantially circular portion and to have a circumferential end side of said metal strip positioned adjacent a bend connecting said circular portion to said diametrical portion;

cutting a cut-free section in said metal strip to form a lug adjacent said clamping slot and to form a resistance means for forcing said lug against a cable.

* * * * *